US010525611B2

(12) United States Patent
Kurzenberger et al.

(10) Patent No.: US 10,525,611 B2
(45) Date of Patent: Jan. 7, 2020

(54) HANDHELD WORK APPARATUS

(71) Applicant: Andreas Stihl AG & Co. KG, Waiblingen (DE)

(72) Inventors: Jan Kurzenberger, Koengen (DE); Ulrich Kapinsky, Waiblingen (DE); Roland Hartinger, Leutenbach (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 0 days.

(21) Appl. No.: 16/133,451

(22) Filed: Sep. 17, 2018

(65) Prior Publication Data

US 2019/0084179 A1 Mar. 21, 2019

(30) Foreign Application Priority Data

Sep. 15, 2017 (EP) ..... 17400055

(51) Int. Cl.

| | |
|---|---|
| ***B27B 27/00*** | (2006.01) |
| ***B25B 5/02*** | (2006.01) |
| ***B27B 17/00*** | (2006.01) |
| ***B25F 5/00*** | (2006.01) |
| ***B25F 5/02*** | (2006.01) |

(52) U.S. Cl.
CPC ..... *B27B 17/0033* (2013.01); *B25F 5/006* (2013.01); *B25F 5/02* (2013.01)

(58) Field of Classification Search
CPC ..... B27B 17/0033; B25F 5/02; B25F 5/027; B25F 5/029; B25F 5/006
See application file for complete search history.

(56) References Cited

U.S. PATENT DOCUMENTS

| | | | | |
|---|---|---|---|---|
| 5,699,865 | A | 12/1997 | Foerderer et al. | |
| 7,905,261 | B2 | 3/2011 | Hamisch et al. | |
| 7,909,009 | B2 | 3/2011 | Zimmermann et al. | |
| 8,918,998 | B2 | 12/2014 | Heinzelmann et al. | |
| 2006/0254557 | A1 | 11/2006 | Hamisch et al. | |
| 2006/0254897 | A1* | 11/2006 | Hamisch | B25F 5/02 200/401 |
| 2008/0272268 | A1 | 11/2008 | Zimmermann et al. | |
| 2010/0154226 | A1 | 6/2010 | Heinzelmann et al. | |

* cited by examiner

*Primary Examiner* — Jacob M Amick
(74) *Attorney, Agent, or Firm* — Walter Ottesen, P.A.

(57) ABSTRACT

A handheld work apparatus has a combustion engine with a cylinder. A removable cover is fixed via a closure. The closure includes a tensioning element rotatable about a rotational axis and, in the locked position of the closure, is supported on a tension contour. The closure has a damping element. The damping element is held on a section of the cylinder in the axial direction of the rotational axis. During rotation from unlocked into locked position, the tensioning element is moved by the tension contour in the axial direction of the rotational axis. In the locked position of the closure, the tensioning element clamps the section of the cylinder in the axial direction of the rotational axis between a first abutment and a second abutment of the damping element. In the unlocked position of the closure, the tensioning element is held on the damping element on the cylinder.

15 Claims, 8 Drawing Sheets

HANDHELD WORK APPARATUS

CROSS REFERENCE TO RELATED APPLICATION

This application claims priority of European patent application no. 17 400 055.4, filed Sep. 15, 2017, the entire content of which is incorporated herein by reference.

BACKGROUND OF THE INVENTION

Handheld work apparatuses including a combustion engine customarily have one or more removable covers in order to permit maintenance and cleaning of the components of the work apparatus. Removable covers of this type are known, for example, for the air filter box. By removal of the air filter box cover, the air filter is accessible and can be cleaned and optionally exchanged. The cylinder may also require cleaning, in particular the cooling ribs of the cylinder. The cylinder is therefore also frequently arranged under a removable cover. For easy accessibility of the spark plug, the spark plug may also be arranged under a cover of the work apparatus. The spark plug can be arranged here, for example, under the same cover as the cylinder or as the air filter. It is known to configure closures of this type with a rotatable actuating element.

SUMMARY OF THE INVENTION

It is an object of the invention to provide a handheld work apparatus which has a simple and advantageous construction and permits easy handling.

This object can, for example, be achieved by a handheld work apparatus having: a combustion engine for driving a tool; the combustion engine having a cylinder; a closure including a tensioning element rotatable about a rotational axis and having a locked position and an unlocked position; a removable cover which is fixed via the closure; the tensioning element being supported on a tension contour when the closure is in the locked position; the tensioning element being configured to be rotated by less than one full revolution so as to adjust the closure from the unlocked position to the locked position; the closure having an elastic damping element for vibration-damping fixation of the cover; the damping element having a first abutment configured to support the cover thereon in an axial direction of the rotational axis; the damping element having a second abutment configured to support the tensioning element thereon in the axial direction of the rotational axis; the damping element being held on a section of the cylinder in the axial direction of the rotational axis; the tensioning element being moved by the tension contour in the axial direction of the rotational axis during rotation from the unlocked position of the closure into the locked position of the closure; the tensioning element, when the closure is in the locked position, being configured to clamp the section of the cylinder in the axial direction of the rotational axis between the first abutment and the second abutment of the damping element; and, the tensioning element being held on the damping element on the cylinder when the closure is in the unlocked position.

It is provided that the closure has an elastic damping element for vibration-damping fixing of the cover. The damping element has an abutment for supporting the cover, and a second abutment for supporting the tensioning element. The cover and tensioning element do not have to be directly supported here on the damping element, but may also be supported indirectly on the damping element via further elements. It is provided that the damping element is held on a section of the cylinder in the axial direction of the rotational axis of the closure. During rotation of the tensioning element from the unlocked position of the closure into the locked position of the closure, the tensioning element is moved by the tension contour in the axial direction of the rotational axis. This axial movement of the tensioning element has the effect that, in the locked position of the closure, the tensioning element clamps the section of the cylinder in the axial direction of the rotational axis between the first abutment and the second abutment of the damping element. In the unlocked position of the closure, the tensioning element is held on the damping element on the cylinder.

The transmission of vibrations from the cylinder to the cover is reduced by the damping element. Owing to the fact that the damping element is held on the section of the cylinder and the tensioning element is held on the damping element in the unlocked position of the closure, only the cover has to be removed. The further components of the closure, namely in particular the tensioning element and the damping element, remain on the cylinder. These components are therefore reliably prevented from becoming lost. At the same time, a simple configuration of the cover is produced. In order to fix the cover, the operator merely has to place on the cover and rotate the tensioning element about its axis. Mounting of the tensioning element or of the damping element on the cylinder or cover is unnecessary since the tensioning element and the damping element are already held on the cylinder. This results in a simple construction and simple operation of the closure. The cover itself can be of simple configuration. Owing to the fact that the tensioning element is held on the cylinder via the damping element, the tensioning element is mounted in a vibration-damped manner in relation to the cylinder, and the transmission of vibrations via the tensioning element to the cover is reduced.

The tensioning element can advantageously have a tensioning section, a counterholder and a shaft. The tensioning section can advantageously have at least one locking element which, in the locked position of the closure, is supported on the tension contour. The at least one locking element and the counterholder are connected to each other via the shaft, and the shaft at least partially projects through the damping element. The locking element and the counterholder are in particular arranged at opposite axial ends of the tensioning element. The locking element and the counterholder may advantageously act on the damping element and the cover from opposite sides and thus press the cover and damping element against each other in the locked position of the closure.

The damping element can advantageously have an opening in which the shaft is arranged. That region of the damping element which surrounds the opening preferably at least partially overlaps the contour of the tensioning section in the unlocked position of the closure and thereby secures the tensioning element in the axial direction of the rotational axis on the damping element. Accordingly, the tensioning section engages behind the damping element adjacent to the opening. Additional elements for securing the tensioning element on the damping element can be omitted as a result. Owing to the elasticity of the damping element, mounting of the tensioning element on the damping element is advantageously nevertheless possible. The damping element here is in particular configured as a single part, and the tensioning element is mounted on the damping element by elastic deformation of the damping element.

The damping element advantageously has a slot which, in one position of the closure, at least partially overlaps with the at least one locking element. The slot can advantageously be dimensioned in such a manner that, for the mounting of the tensioning element on the damping element, the tensioning section can be pushed through the slot by elastic deformation of the damping element when the damping element is not held on the cylinder.

The damping element may advantageously be arranged in a receptacle of the cylinder. In order to avoid the tensioning element being able to be removed from the damping element by deformation of the damping element, when the damping element is held on the cylinder, it is provided that the receptacle limits the elastic deformation of the damping element transversely with respect to the rotational axis and in particular transversely with respect to the longitudinal direction of the slot in such a manner that, when the damping element is arranged in the receptacle of the cylinder, the tensioning element is held in a form-fitting manner on the damping element. When a damping element is mounted on the cylinder, the tensioning element therefore cannot be removed from the damping element. Securing of the position of the damping element and of the tensioning element in the direction of the rotational axis in relation to the cylinder is achieved in a simple manner via the receptacle.

The receptacle may advantageously bring about rotational securing of the damping element about the rotational axis. It is thereby ensured that, during the rotation of the tensioning element, the damping element cannot rotate together with the tensioning element. This ensures that a defined relative movement takes place between the tensioning element and the damping element. A relative movement between the damping element and the cylinder which is hot during operation and after the combustion engine is switched off is thereby avoided. The wear of the damping element can thereby be reduced.

Owing to the fact that the damping element is secured against rotation in relation to the cylinder, the position of the tensioning element can be secured in the unlocked or locked position via a latching unit between the tensioning element and the damping element.

The receptacle limits or preferably also prevents bulging of the damping element. The form-fitting rotational securing is advantageous in relation to rotational securing of the damping element via axial compression since, even when the axial compression of the damping element is reduced, in particular even in the unlocked position of the closure, there is rotational securing for the damping element.

The damping element can advantageously be pushed in an insertion direction into the receptacle. The slot can preferably run approximately parallel to the insertion direction. Receptacle sides running in the insertion direction can thereby prevent bulging of the damping element in a simple manner and can secure the damping element in its rotational position.

At least one disk, in particular a disk made of metal, can advantageously be arranged between the counterholder and the second abutment of the damping element. The disk reduces the wear between the counterholder and the damping element. The counterholder may advantageously rotate here with the at least one locking element about the rotational axis of the tensioning element. On account of the arrangement on the cylinder, which is very hot during operation, the damping element is highly loaded thermally and is thereby susceptible to wear. This wear can be reduced via the at least one disk between counterholder and the second abutment of the damping element. Via the selection of a suitable friction pairing of counterholder and disk, the operating forces which have to be applied for actuating the closure can be increased or reduced in a targeted manner, and therefore ergonomic actuation of the closure can be made possible.

Advantageously, a stop may be formed between the tensioning element and the damping element, the stop defining the position of the tensioning element in relation to the first abutment of the damping element with respect to the axial direction of the rotational axis in such a manner that, in the unlocked position of the closure with the cover placed thereon, the distance, measured in the axial direction of the rotational axis, between the locking element and the counterholder is greater than the smallest distance, measured in the axial direction of the rotational axis, between the tension contour and the counterholder. The distance between the locking element and the counterholder can advantageously be at least 1 mm, preferably at least 2 mm greater than the distance between the tension contour and the counterholder. Owing to the fact that the distance between the locking element and the counterholder is greater than the distance between the tension contour and the counterholder, the at least one locking element projects beyond the lowest point of the tension contour when the cover is placed thereon. The distances between the locking element and the counterholder or between the tension contour and the counterholder can preferably be measured here when the damping element is unloaded. As a result, when the cover is placed onto the work apparatus, the locking element then already projects axially into the region or to the height level of the tension contour when the cover has not yet been pressed onto the damping element. Accordingly, for fixing the cover, the operator merely has to place on the cover and rotate the tensioning element into the locked position. The cover does not need to be pressed on since the locking element already lies axially above the tension contour when the cover is placed on, and, during rotation of the tensioning element into the locked position, the tension contour in the cover automatically presses the cover against the damping element. Simple handling of the closure is thereby ensured.

The stop between the tensioning element, in particular the tensioning section, and the damping element advantageously also ensures that the locking element is at a distance from the damping element in the unlocked state. The distance can advantageously exist here both when the cover is placed on and when the cover is removed. The tension contour engages in the distance between the locking element and the damping element and, upon further rotation, moves the tensioning element in the axial direction of the rotational axis as far as the locked position of the tensioning element.

The tensioning element advantageously has an adjusting device for adjusting the tensioning element between the unlocked position and the locked position of the closure. The adjusting device for adjusting the tensioning element can preferably include an engaging contour for engagement of a tool. A toggle, at which the operator can directly actuate the tensioning element, may also be advantageous. The adjusting device or means for adjusting the tensioning element can preferably be arranged on the tensioning section. It may be advantageous to form the locking element and the adjusting device for adjusting the tensioning element on one component. When the cover is placed on, the tension contour and the adjusting device for adjusting the tensioning element are advantageously provided on the same side of the closure, preferably on the side of the closure that projects onto the outer side of the housing. The counterholder may advantageously be arranged on the other side of the closure, which side is arranged within the housing. The adjusting device for adjusting the tensioning element and the counterholder can preferably be arranged on opposite sides of the section of the cylinder and on opposite sides of the cover. Advantageously, the adjusting device for adjusting the tensioning element is arranged at one end of the tensioning element, and the counterholder is arranged at the other end of the tensioning element, in particular the end projecting into the housing. The adjusting device for adjusting the tensioning element and the counterholder are advantageously provided on opposite sides of the shaft.

The closure advantageously has means for securing the rotational position of the tensioning element in the unlocked position. It is thereby ensured that, in the unlocked position of the closure, the tensioning element does not rotate in relation to the damping element. If the cover is placed on in the unlocked position of the tensioning element, the tensioning element is in the designated position and can be plugged directly through a housing opening. The housing opening advantageously overlaps with the tensioning section and in particular is adjacent to the tension contour. In order to secure the rotational position of the tensioning element, a latching unit acting between the tensioning element and the damping element is advantageously provided. A latching position is advantageously assigned to the position of the tensioning element in the unlocked position. In a configuration, a further latching position is assigned to the position of the tensioning element in the locked position. Positional securing in the locked position is therefore achieved via the latching unit between the tensioning element and the damping element. The angle between the two latching positions advantageously corresponds here to the angle about which the tensioning element is to be rotated about the rotational axis between the unlocked position and the locked position. The angle between the unlocked position and the locked position is in particular less than 270°, particularly expediently less than 180°. A further latching unit can preferably be formed on the tension contour and acts between the locking element and the cover. The further latching unit can advantageously have a latching position which is assigned to the locked position of the closure.

A simple configuration is produced if the latching unit which secures the rotational position of the tensioning element in the unlocked position is formed between the shaft of the tensioning element and the opening of the damping element, in particular the peripheral contour of the opening of the damping element. In an alternative advantageous configuration, it is provided that the latching unit is formed between the counterholder and the damping element.

The damping element advantageously at least partially lies against a cooling rib of the cylinder. A receptacle in which the damping element is arranged can preferably be formed on a cooling rib of the cylinder. The damping element can advantageously have a delimiting stop which limits the insertion depth into the receptacle of the cylinder. In a particularly advantageous configuration, the damping element lies with the delimiting stop against the cooling rib of the cylinder.

The damping element can advantageously be oriented in such a manner that the second abutment of the damping element runs in an inclined manner with respect to at least one cooling rib of the cylinder. This is advantageous in particular whenever the cylinder longitudinal axis in the housing is arranged in an inclined manner, and therefore the cooling ribs also run in an inclined manner in relation to the upper side of the housing. The damping element can preferably be beveled on a transverse side. The bevel is advantageously configured in such a manner that the damping element only projects slightly, if at all, into a cooling channel formed between the cooling ribs. The damping element can preferably project by less than 2 mm into the cooling air channel formed between the cooling ribs.

The tension contour is advantageously arranged on the cover. In a configuration, the tension contour is formed in one part with the cover. Advantageously, the contour of the cover can be manufactured together with the tension contour, in particular by injection molding, preferably from plastic.

The closure can advantageously include the tension contour, the tensioning element and the damping element. In the unlocked position of the closure, the tension contour is advantageously removable together with the cover while the remaining components of the closure, namely the tensioning element and the damping element, remain on the cylinder and are held thereon.

The work apparatus advantageously has a covering for the closure, which covering is held on the cover and which at least partially covers the at least one locking element. In particular whenever an engaging contour for the engagement of a tool is provided on the tensioning element and is formed separately from the locking element, the operator does not need the locking elements in order to operate the closure. Owing to the fact that the locking elements and therefore also the tension contour are at least partially, preferably substantially or completely, covered by the covering, the soiling tendency on locking elements and tension contour is reduced.

The tension contour is advantageously formed by at least one ramp running in the peripheral direction with respect to the rotational axis. This results in a virtually helical profile of the tension contour that is wedge-shaped in a section in the peripheral direction.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
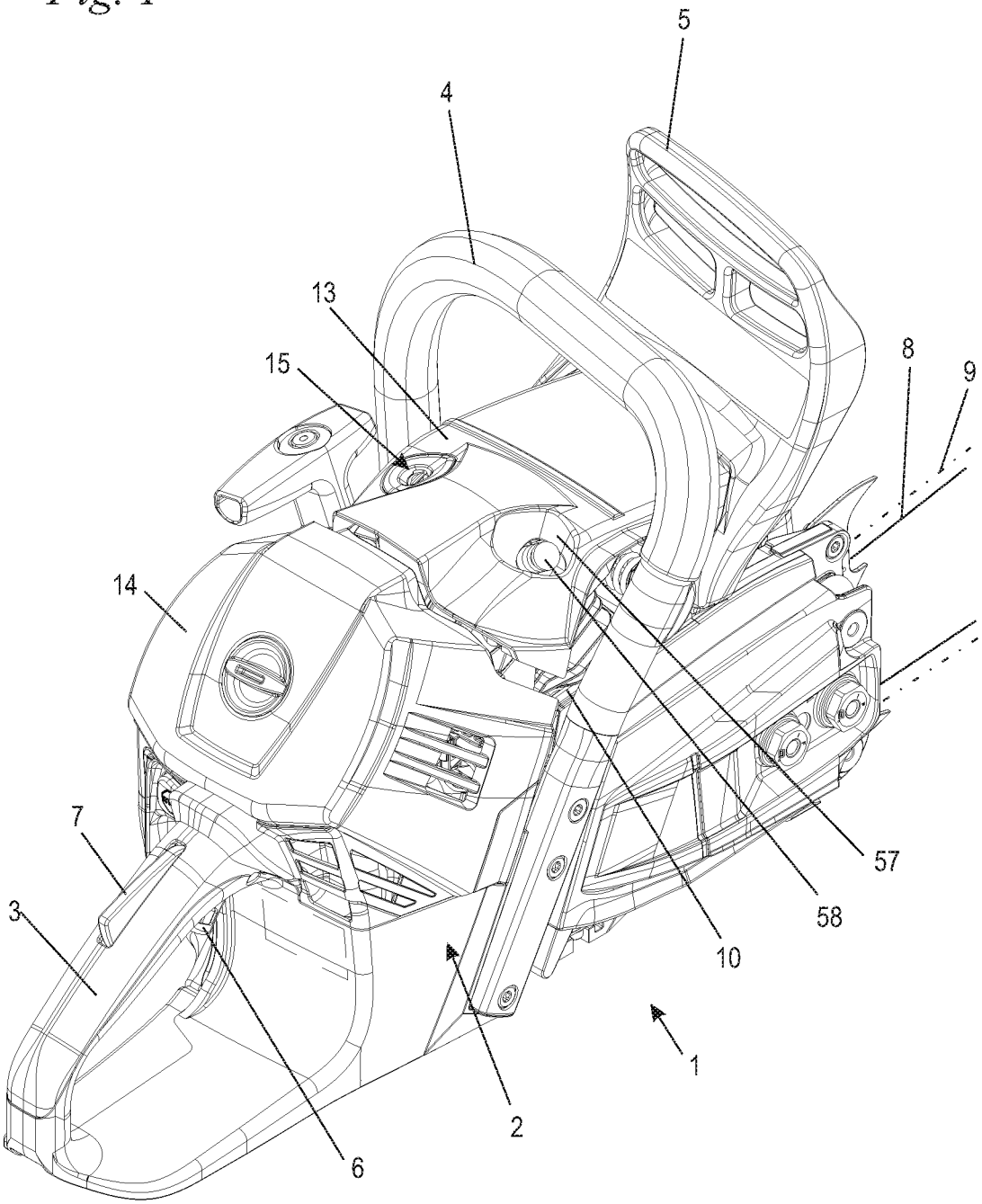
FIG. 1 shows a perspective illustration of a work apparatus.

FIG. 1 shows a handheld work apparatus 1 in a perspective view. In the embodiment, the work apparatus 1 is a portable, handheld power saw. The handheld work apparatus may, however, be a different work apparatus, for example a brush cutter, an angle grinder, a blower apparatus or the like. The work apparatus 1 has a housing 2 in which a combustion engine 10 is arranged. The combustion engine 10 can only partially be seen between the housing parts of the housing 2 in FIG. 1. In order to guide the work apparatus 1, a rear handle 3 and a bale handle 4 are provided. The work apparatus 1 has a guide bar 8 on which a saw chain 9 (shown schematically) is driven in circulating fashion. The saw chain 9 is driven by the combustion engine 10. A hand protector 5, which is fixed to the housing 2, is arranged on that side of the bale handle 4 which faces the saw chain 9. In a configuration, the hand protector 5 serves for actuating a brake device for the saw chain 9. A throttle lever 6 and a throttle lever lock 7 are mounted pivotably on the rear handle 3. The throttle lever 6 serves for activating the combustion engine 10.

The housing 2 includes a cover 13 which is fixed via a releasable closure 15. The cover 13 forms part of the outer casing of the work apparatus 1. The cover at least partially covers the combustion engine 10 of the work apparatus 1. In the embodiment, the cover 13 forms part of the housing 2. The housing 2 is assembled here from a plurality of components which can also have other functions. The housing 2 is in particular not a closed housing. In addition, the housing 2 includes a releasably fixed air filter cover 14. An opening 58 which is arranged in a recess 57 is provided on the cover 13.

Figure 2:
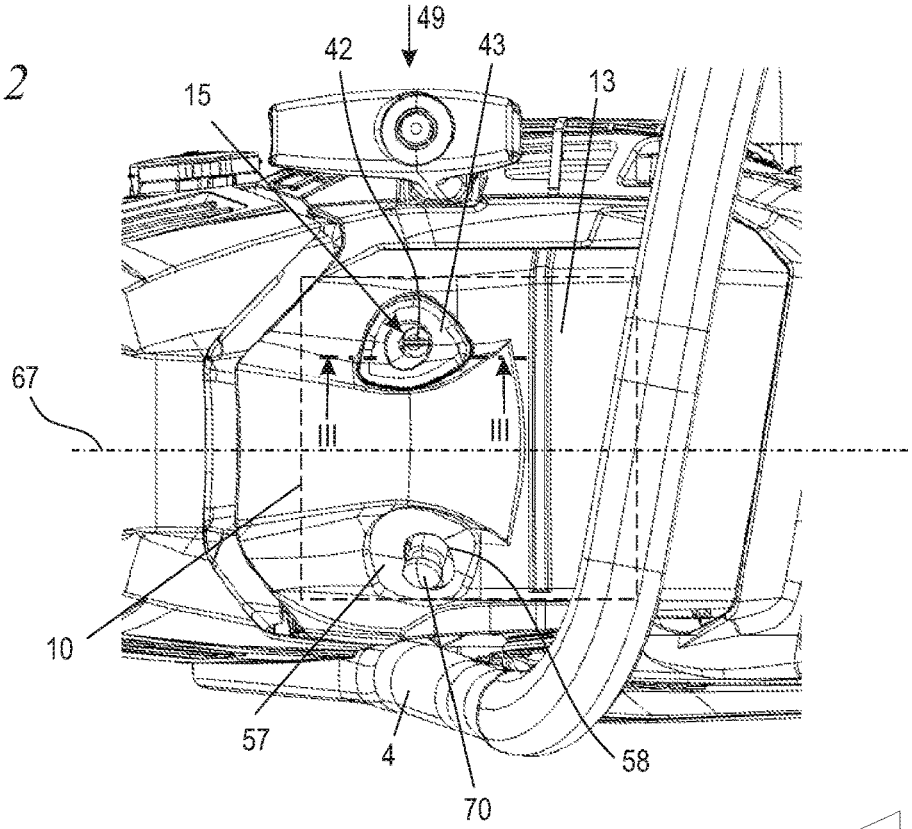
FIG. 2 shows a partial illustration of the work apparatus from FIG. 1 from above.

As FIG. 2 shows, an actuating part of a decompression valve 70 of the combustion engine 10 projects through the opening 58. The work apparatus 1 has a longitudinal center plane 67 which is shown schematically in FIG. 2 and runs parallel to the plane of the guide bar 8 (FIG. 1). The rear handle 3 advantageously lies approximately parallel to the longitudinal center plane 67, and preferably at least partially in the longitudinal center plane 67. The closure 15 and the decompression valve 70 are arranged approximately symmetrically with respect to the longitudinal center plane 67 and on both sides of the longitudinal center plane 67. The closure 15 has an engaging contour 42 for the engagement of a tool. In the embodiment, the engaging contour 42 is configured as a slot for the engagement of a screwdriver. As FIG. 2 also shows, a covering 43 (which will be described in more detail below) which is fixed to the cover 13 extends outside the engaging contour 42.

Figure 3:
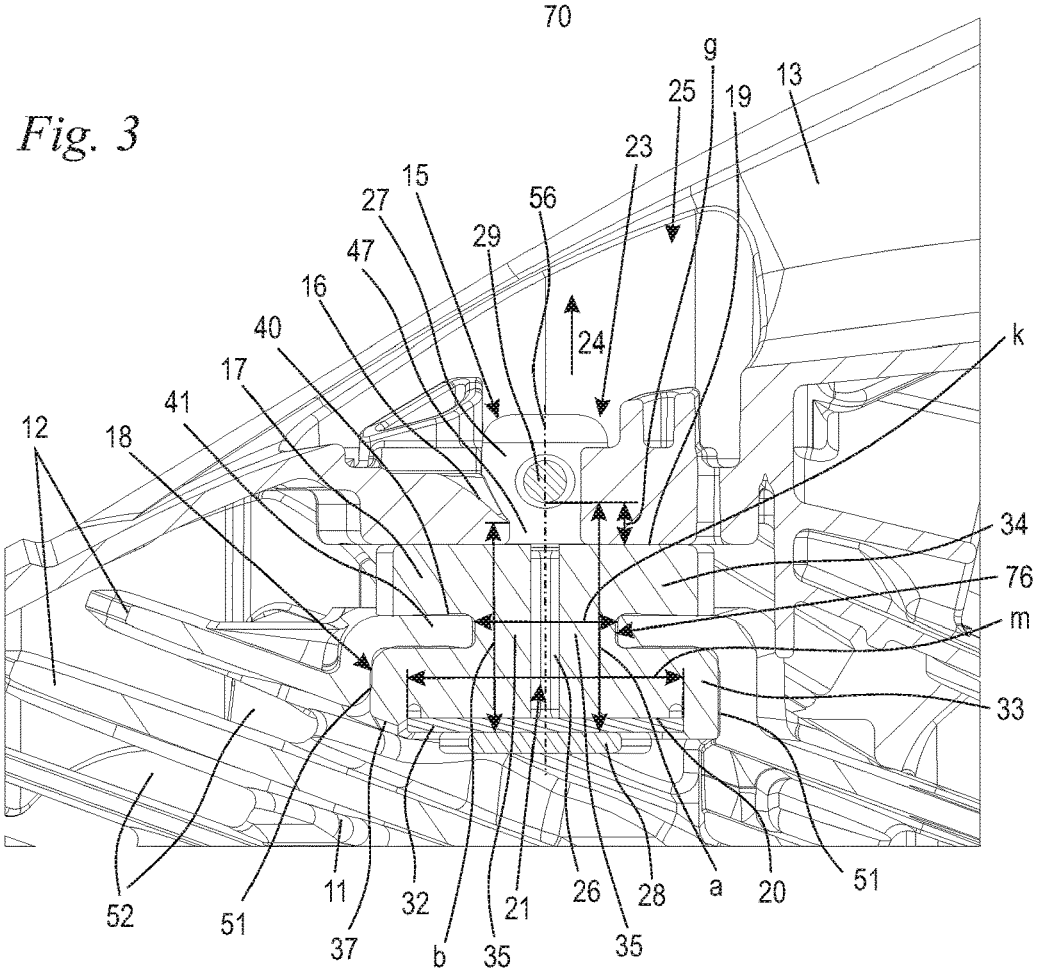
FIG. 3 shows a partial sectional illustration along the line III-III in FIG. 2.

FIG. 3 shows the configuration of the closure 15 in detail. As FIG. 3 shows, the closure 15 includes a damping element 17, a tensioning element 21 and a tension contour 16 formed integrally on the cover 13. The damping element 17 is held on a cylinder 11 of the combustion engine 10. The cover 13 at least partially covers the cylinder 11 of the combustion engine 10. The cylinder 11 has a plurality of cooling ribs 12, between which cooling air channels 52 run. A fan wheel (not shown in the figures) which is driven by the combustion engine 10 conveys cooling air through the cooling air channels 52. A receptacle 18 for the damping element 17 is formed on one of the cooling ribs 12, on the upper cooling rib 12, which faces the cover 13, in the embodiment. The damping element 17 has a first section 33 and a second section 34. Webs 35 run between the sections 33 and 34, the webs being set back in relation to the outer contour of the sections 33 and 34 and therefore forming cutouts 40 in which a section 41 of the cylinder 11 engages. The damping element 17 can be pushed into the receptacle 18 in an insertion direction 49, which is shown in FIG. 2, and can be removed from the receptacle 18 in the opposite direction. Further means for fixing the damping element 17 in the receptacle 18 are advantageously not provided. A breakout 76 through which the damping element 17 projects is formed on the section 41 of the cylinder 11.

The tensioning element 21 has a shaft 26, a tensioning section 27 and a counterholder 28. The tensioning section 27 and the counterholder 28 are arranged at opposite ends of the shaft 26 and are connected to each other via the shaft 26. The tensioning section 27 and the counterholder 28 are advantageously at least partially formed together with the shaft 26 from a single part. The tensioning section 27 has at least one locking element 29. In the embodiment, two mutually opposite locking elements 29 are provided. A different number of locking elements 29 may also be advantageous. The at least one locking element 29 is expediently configured as a part separate from the shaft 26 and is pushed or pressed into the tensioning section 27.

The damping element 17 has a first abutment 19 which is supported on the cover 13. In the embodiment, the cover 13 lies directly against the first abutment 19 of the damping element 17. In addition, the damping element 17 has a second abutment 20, on which the counterholder 28 is directly or indirectly supported. In the embodiment, a disk 32 is arranged between the counterholder 28 and the second abutment 20. The disk 32 is made of metal. The width m of the disk 32 is greater than a width k of the breakout 76 in the section 41 of the cylinder 11. The width m and the width k are measured here in the same direction perpendicular to the rotational axis 56 and in particular between the two cutouts 40. The width m of the disk 32 is advantageously at least 1.2 times, in particular at least 1.4 times the width k of the breakout 76. Owing to the fact that the width m of the disk 32 is greater than the width k of the breakout 76, it is avoided that the damping element 17 can be deformed and partially pulled with its first section 33 into the breakout 76. The wear of the damping element 17 is thereby reduced.

The cutout 40 into which the section 41 of the cylinder 11 projects is located between the abutments 19 and 20. The abutment 19 lies against the inner side of the cover 13. The tension contour 16 is formed on the outer side of the cover 13. As FIG. 3 shows, the tension contour 16 runs in a ramp- or wedge-shaped manner in the peripheral direction. The tension contour 16 is advantageously formed helically about a rotational axis 56 of the tensioning element 21. The tension contour 16 advantageously extends here only over a partial angle about the rotational axis 56. In particular, the tension contour 16 runs in a ramp-shaped manner about the rotational axis 56. The partial angle here can preferably be smaller than the angle of rotation about which the tensioning element 21 has to be rotated between the unlocked position and locked position. A latching recess 46 (FIG. 4) for the locking element 29 is located in the remaining peripheral section between the partial angle and angle of rotation, the latching recess preventing the locking element 29 from sliding down, that is, rotating back, on the ramp of the tension contour 16.

FIG. 3 shows the closure 15 in the unlocked position 23. In this position, the tensioning section 27 completely overlaps with a pass-through opening 47 formed in the cover 13. The locking element 29 is not in contact with the tension contour 16. The locking element 29 has a distance a, measured parallel to the rotational axis 56, from the counterholder 28. The tension contour 16 has a smallest distance b from the counterholder 28. The smallest distance b is advantageously measured at that region of the tension contour 16 which, during the rotation of the tensioning element 21 from the unlocked position 23 into the locked position 22, first of all comes into overlap with the locking element 29. The distance b is smaller than the distance a, and therefore the tension contour 16 can grip under the locking element 29 during rotation of the tensioning element 21. For this purpose, the tensioning element 21 is secured in its position in the direction of the rotational axis 56 in relation to the damping element 17, as is also described in more detail below. FIG. 3 shows the arrangement of the closure 15 after the cover 13 has simply been placed thereon. The cover 13 has not been pressed downward by the operator, and therefore the damping element 17 is not compressed by the cover 13.

As FIG. 3 also shows, in the unlocked position 23, which is shown in FIG. 3, the locking element 29 has a distance g from the damping element 17. Owing to the fact that the locking element 29 lies above the damping element 17, the tension contour 16 can readily grip under the locking element 29, that is, can pass between the damping element 17 and the locking element 29. The positional designations "above" or "over" and "below" or "under" relate here to a perpendicular arrangement of the rotational axis 56 and to an arrangement of the tensioning section 27 over the counterholder 28. This position is shown in FIG. 3. In this position, the rotational axis 56 lies in the direction of action of gravity, and the tensioning element 21 advantageously supports its gravitational force on the tensioning section 27 against the damping element 17.

If the tensioning element 21 is rotated in the direction of the locked position 22, the locking element 29 comes into contact with the tension contour 16. The tension contour 16 moves the tensioning element 21 in a tensioning direction 24 in the direction of the rotational axis 56. The tensioning direction 24 is directed from the counterholder 28 to the tensioning section 27. As a result, the cover 13 is pressed via the tension contour 16 to the cylinder 11 and, in the process, compresses the damping element 17. The section 41 of the cylinder 11 remains positionally fixed while the tensioning element 21 in FIG. 3 moves upward, and the cover 13 in FIG. 3 moves downward, that is, in the direction of the cylinder 11. As FIG. 3 also shows, the tensioning section 27 is arranged in a recess 25 of the cover 13, which recess is partially closed by the covering 43 (FIG. 2).

As FIG. 3 also shows, the damping element 17 has a bevel 37 on its side facing away from the cover 13. As FIG. 3 shows, the cooling channels 52 run obliquely with respect to the rotational axis 56. The damping element 17 therefore also lies obliquely with respect to the cooling channels 52. The bevel 37 is arranged in such a manner that the damping element 17 only insignificantly projects, if at all, into the cooling air channel 52. The bevel 37 is advantageously configured in such a manner that the damping element 17 projects less than 2 mm into the cooling air channel 52 formed between the cooling ribs 12. In the embodiment, the bevel 37 lies in one plane with the lower side of the adjacent cooling rib 12. The bevel 37 is arranged on the first section 33 of the damping element 17, which section is arranged in the receptacle 18.

Figure 4:
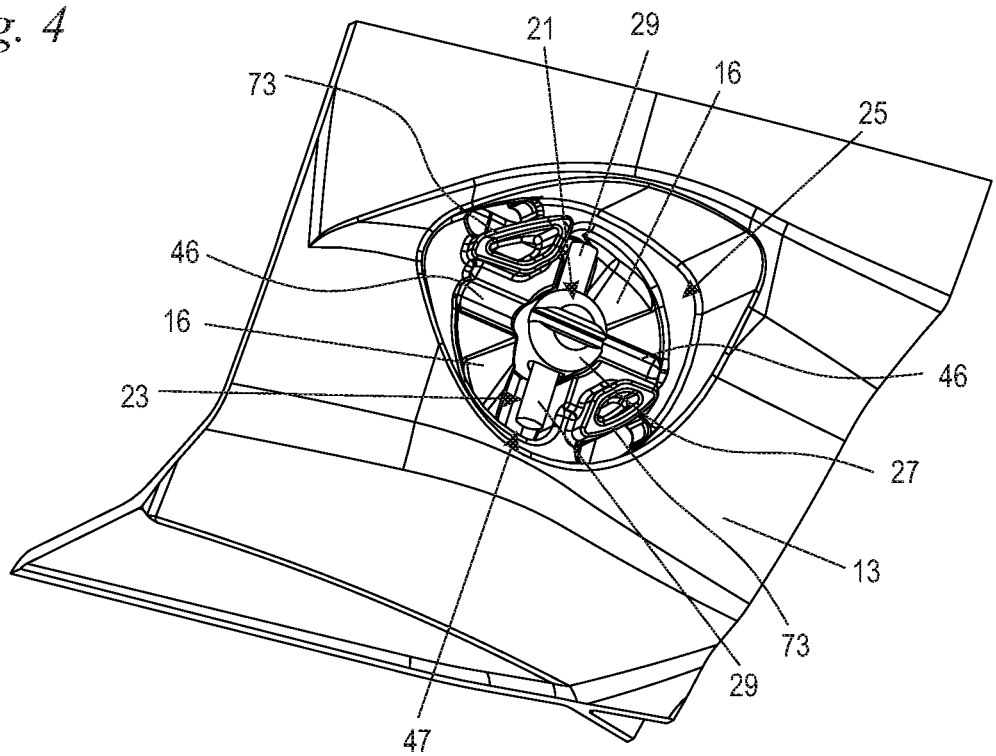
FIG. 4 shows a perspective illustration of the cover in the region of the closure.

FIG. 4 shows the cover 13 with that section of the tensioning element 21 which projects to the outer side of the housing 2. As FIG. 4 shows, two mutually opposite locking elements 29 are provided. In the unlocked position 23 shown in FIG. 4, the locking elements 29 like the tensioning section 27 of the tensioning element 21 overlap with the pass-through opening 47 of the cover 13. In the unlocked position 23, the cover 13 can thereby be placed onto the tensioning element 21 or lifted off from the tensioning element 21. As FIG. 4 also shows, a tension contour 16 which runs helically is in each case arranged in the peripheral direction adjacent to each locking element 29. Each tension contour 16 is adjoined by a latching recess 46 which defines the locked position of the closure 15.

Figure 5:
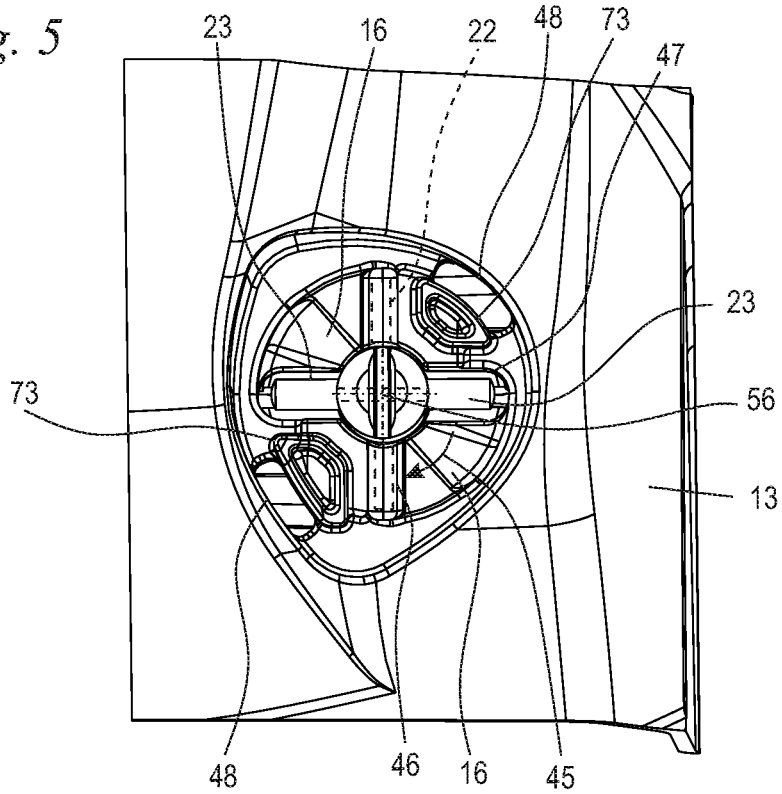
FIG. 5 shows a top view of the detail of the cover from FIG. 4.

FIG. 5 shows the locked position 22 schematically with a dashed line. In the locked position 22, the locking elements 29 lie in the associated latching recesses 46. FIG. 4 and FIG. 5 also show latch openings 48 of the cover 13, in which latch openings the covering 43 is to be fixed.

In the embodiment, the tensioning element 21 is to be rotated in a rotational direction 45 about the rotational axis 56 for locking purposes. In the embodiment, the rotational direction 45 runs from the top in the clockwise direction in a view of the cover 13. As FIGS. 4 and 5 also show, elevations 73 are formed on the cover 13 and structurally prevent rotation of the tensioning element 21 in the opposite direction, that is, anticlockwise in the embodiment. In the embodiment, the elevations 73 also serve for positioning the covering 43. In the embodiment, the tensioning element 21 is to be rotated by 90° between the unlocked position 23 and the locked position 22. However, a different angle of rotation between the unlocked position 23 and the locked position 22 may also be advantageous. The angle of rotation is, however, smaller than 360°, and therefore the tensioning element 21 has to be rotated by less than one revolution between the unlocked position 23 and the locked position 22. In particular, the angle of rotation is smaller than 180°, and therefore the tension contour 16 in each case extends only on one side of the pass-through opening 47.

Figure 6:
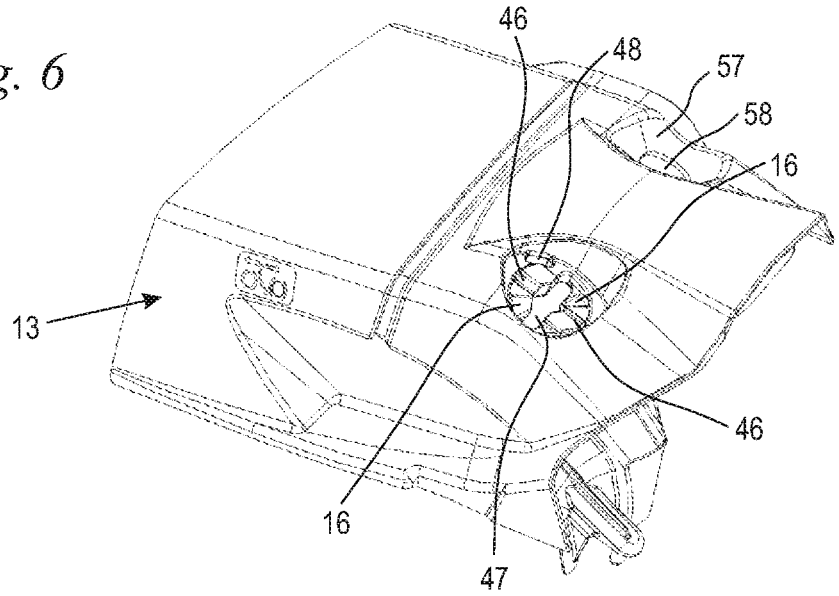
FIG. 6 shows a perspective illustration of the upper side of the cover.
Figure 7:
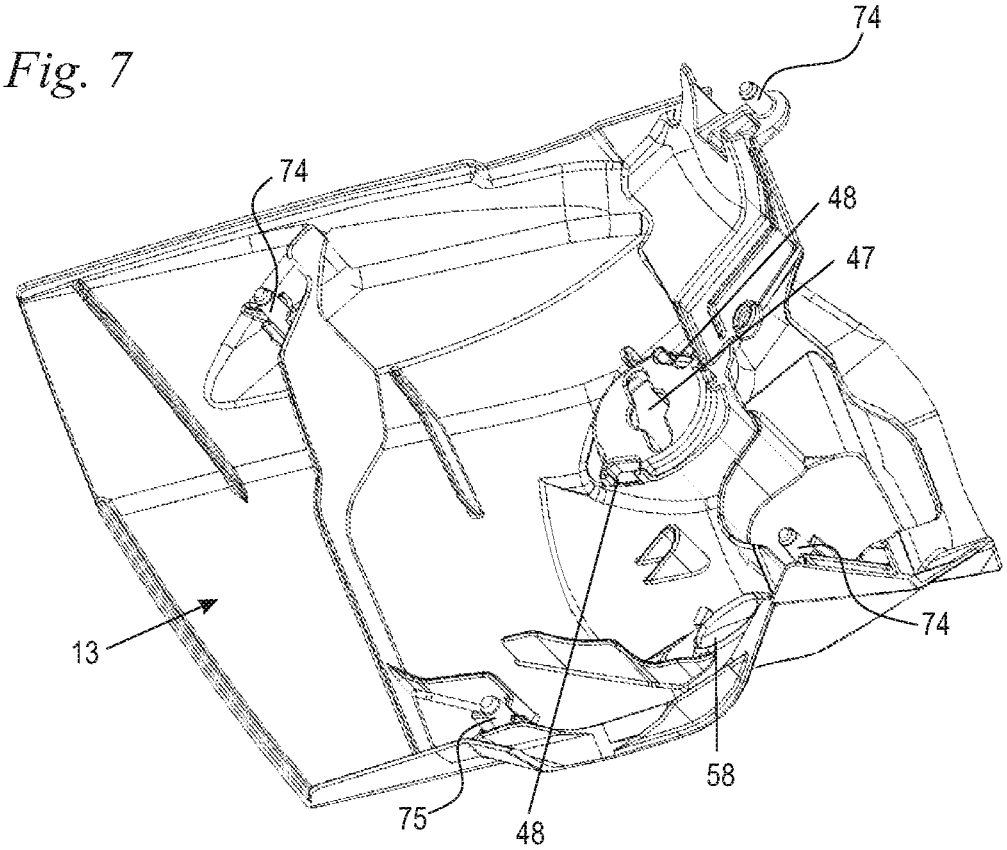
FIG. 7 shows a perspective illustration of the lower side of the cover.

FIGS. 6 and 7 show the configuration of the cover 13 in detail. As FIG. 6 shows, the pass-through opening 47 is formed in a toggle-shaped manner with an approximately circular central region and two narrower regions extending outward radially therefrom. The contour of the pass-through opening 47 advantageously approximately corresponds to the contour of the tensioning section 27 including the locking elements 29. FIG. 6 and FIG. 7 also show the latch openings 48 for the covering 43. In addition, the opening 58 for the decompression valve 70 can be seen in FIGS. 6 and 7. When the cover 13 is removed, only the pass-through opening 47 and the tension contour 16 of the closure 15 are formed on the cover 13. The further components of the closure 15 are held on the cylinder 11.

Support pins 74 and 75 are arranged in FIG. 7. In the embodiment, three support pins 74 and one support pin 75, which approximately span a square, are provided. The support pins 74 and 75 are supported on damping elements (not shown) on components of the work apparatus 1 that are connected to the cylinder 11 or to a crankcase (not shown), and thus support the cover 13 in the axial direction of the rotational axis 56. In the embodiment, the support pins 74 enter rubber-mounted sleeves and thus secure the cover 13 in the perpendicular direction to the rotational axis 56. The support pin 75 enters a damping element which merely rests on a rib of the cylinder 11, and therefore the cover 13 is supported exclusively in the axial direction of the rotational axis 56.

Figure 8:
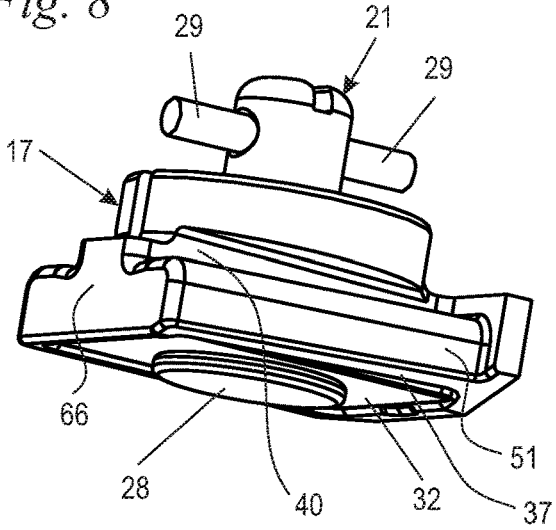
FIG. 8 shows a perspective illustration of the damping element, tensioning element and disk of the closure.

FIG. 8 shows the components which are held on the cylinder 11, namely the damping element 17, the tensioning element 21 and the disk 32. FIG. 8 shows the arrangement in a preassembled state, in which the arrangement can be pushed in the insertion direction 49, shown in FIG. 2, into the receptacle 18 of the cylinder 11 (FIG. 3).

Figure 9:
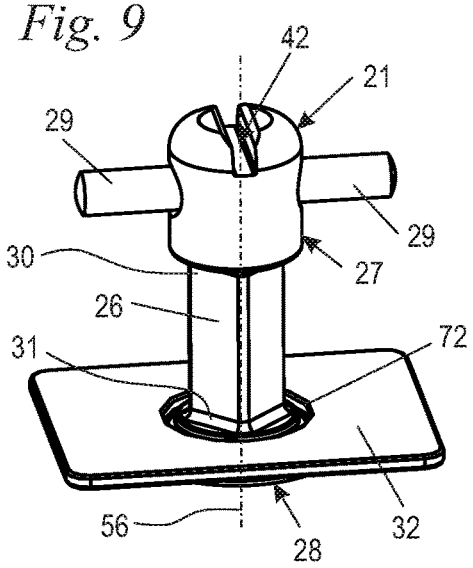
FIG. 9 shows a perspective illustration of the tensioning element and the disk.
Figure 10:
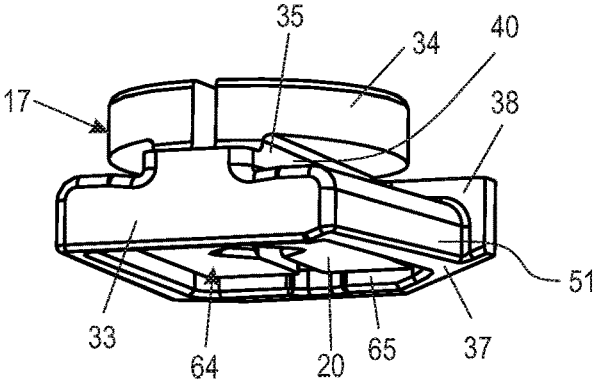
FIG. 10 and FIG. 11 show perspective illustrations of the damping element.

As FIGS. 8 and 9 show, the disk 32 has a rectangular configuration. The disk 32 is arranged in a recess 64 of the damping element 17. The base of the recess 64 forms the second abutment 20. As FIG. 10 shows, the recess 64 is surrounded by a peripheral wall 65. The peripheral wall 65 tightly encloses the disk 32 on the periphery thereof, or at a very small distance, and therefore the disk 32 is secured by the peripheral wall 65 of the recess 64 against rotation in relation to the damping element 17.

Figure 12:
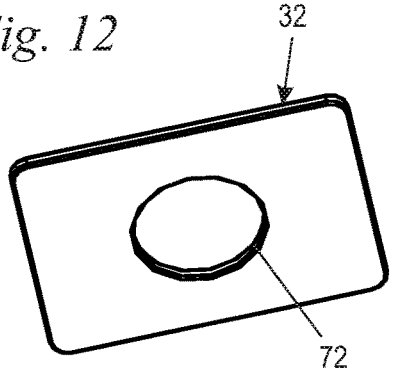
FIG. 12 shows a perspective illustration of the disk.

As FIG. 9 shows, the shaft 26 has a cross section which is noncircular, preferably polygonal, and square in the embodiment. The disk 32 has an opening 72 (FIGS. 9 and 12) which, in the embodiment, has a round cross section. The opening 72 is dimensioned in such a manner that the tensioning element 21 can rotate freely in the opening 72. As FIGS. 8 and 9 also show, the counterholder 28 in the embodiment is configured as a disk with a circular cross section. The shaft 26 has a first end 30, at which the tensioning section 27 is arranged. In addition, the shaft 26 has a second end 31, at which the counterholder 28 is arranged. Accordingly, the counterholder 28 and the tensioning section 27 are arranged at opposite ends of the shaft 26. As FIG. 8 in conjunction with FIG. 9 shows, the shaft 26 protrudes through the damping element 17.

As FIGS. 8 and 10 show, the cutouts 40, in which the section 41 of the cylinder 11 engages, are formed between the sections 33 and 34 of the damping element 17 (FIG. 3). In addition, a delimiting stop 38, at which the first section 33 is of thickened configuration, is formed on the damping element 17. The delimiting stop 38 limits the insertion depth of the damping element 17 into the receptacle 18 (FIG. 3). As FIGS. 8 and 10 show, the bevel 37 is formed on a transverse side 51 of the damping element 17. The sections 33 and 34 are connected via two webs 35. The webs 35 extend between the two cutouts 40. In the embodiment, the first section 33 has a rectangular cross section while the second section 34 has a round cross section.

Figure 11:
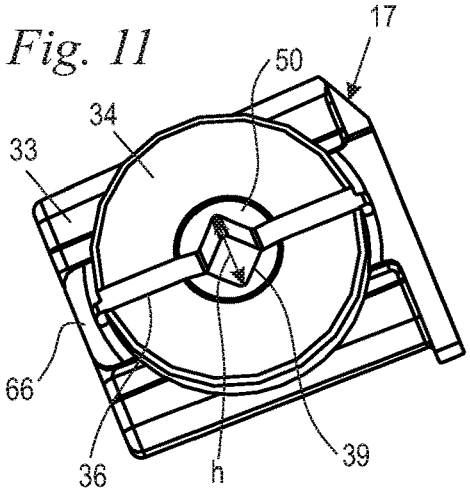

As in particular FIG. 11 shows, the damping element 17 has a slot 36. The webs 35 are separated from each other by the slot 36. In the embodiment, the slot 36 extends over the entire diameter of the second section 34 and projects through the second section 34 in a direction perpendicular to the rotational axis 56 (FIG. 9). As FIG. 11 also shows, the damping element 17 has an opening 39 for the shaft 26. A stop 50 is formed on the second section 34 adjacent to the opening 39, on that region of the damping element 17 which surrounds the opening. In the embodiment, the stop 50 is in the form of a recess of the damping element 17. The stop 50 at least partially overlaps the contour of the tensioning section 27 at least in the unlocked position 23 of the closure 15. In the embodiment, the stop 50 overlaps the contour of the tensioning section 27 in each position of the tensioning element 21. The tensioning section 27 of the tensioning element 21 lies against the stop 50 (FIG. 9). As a result, the tensioning element 21 is secured in position in relation to the damping element 17 in the direction of the rotational axis 56. As FIG. 11 also shows, the opening 39 has a square cross section which corresponds to the cross section of the shaft 26 with little play. On account of their noncircular cross section coordinated with each other, the opening 39 and the shaft 26 form a latching unit 53 (FIG. 14) which, in the embodiment, defines four latching positions of the shaft 26 in relation to the damping element 17. On account of the symmetrical configuration of the tensioning element 21, two of the latching positions are assigned to the unlocked position 23 and the two other latching positions are assigned to the locked position 22 of the closure 15. As a result of the fact that a latching position is also assigned to the locked position 22, the shaft 26 lies with little play in the opening 39 in the locked position 22. As a result, in the locked state 22, that is, also during the operation of the work apparatus 1, the damping element 17 is relaxed at the opening 39 transversely with respect to the rotational axis 56, and the loading of the damping element 17 and therefore the wear are reduced. In the embodiment, an angle of 90° is provided between the locked position 22 and unlocked position 23 of the at least one locking element 29. This angle therefore corresponds to the angle between the latching positions of the latching unit 53.

Figure 13:
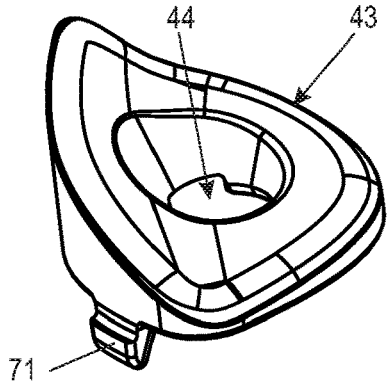
FIG. 13 shows a perspective illustration of a covering.

As FIG. 13 shows, the covering 43 has an opening 44 through which the engaging contour 42 is accessible from the outside. The locking elements 29 are substantially, in particular completely, covered by the covering 43, as in particular FIG. 2 shows. Latching elements 71 are integrally formed on the covering 43, the latching elements being able to be inserted into the latch openings 48 in the cover 13 and latched there to the cover 13 (FIGS. 4 and 5). The view of the locking element 29 and the pass-through opening 47 of the cover 13 is made difficult or prevented by the covering 43. Nevertheless, simple placing of the cover 13 is possible since the latching unit 53 between the tensioning element 21 and the damping element 17 prevents unintentional rotation of the tensioning element 21 during or after removal of the cover 13. The position of the locking element 29 after removal of the cover 13 thereby corresponds to the position before the cover 13 is placed on again. Since the cover 13 can only be placed on or removed in a single orientation, the locking elements 29 and the pass-through opening 47 are automatically aligned with one another. Visual inspection of the orientation of the locking element 29 or rotation at all of the tensioning element 21 is unnecessary in order to place the cover 13 correctly onto the damping element 17.

Figure 14:
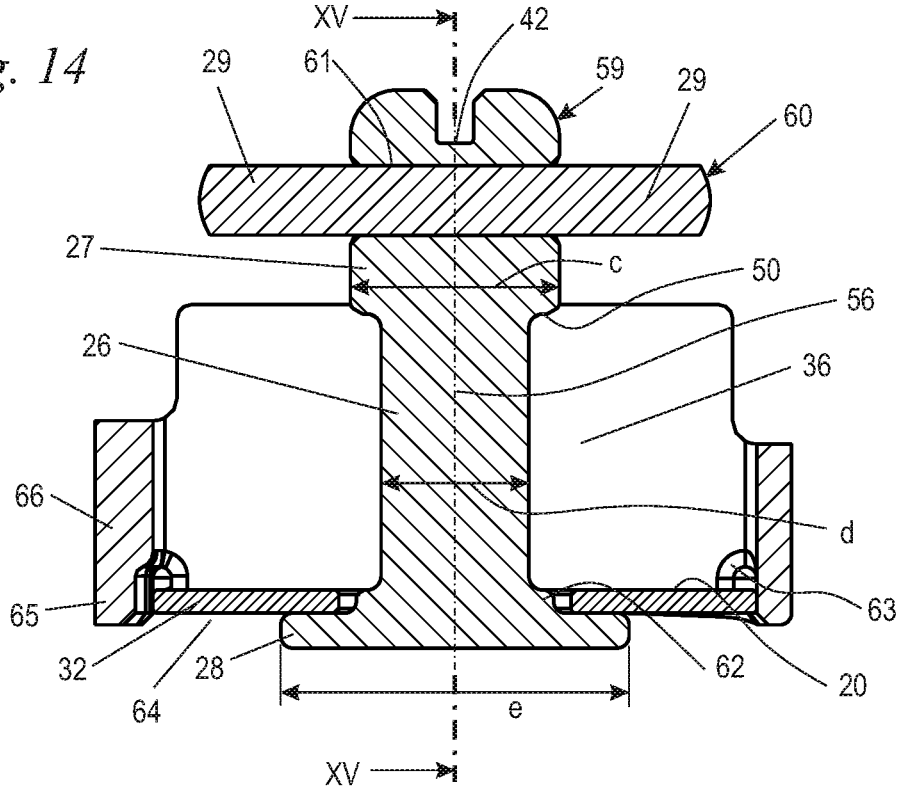
FIG. 14 shows a section through the damping element, tensioning element and disk along the line XIV-XIV in FIG. 15.
Figure 15:
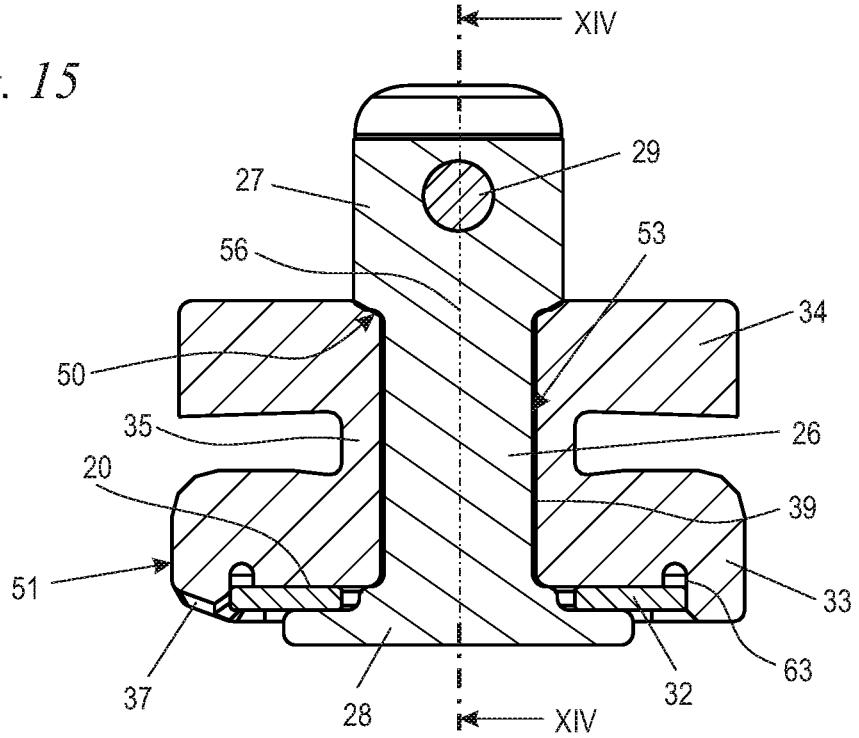
FIG. 15 shows a section through the damping element and the tensioning element along the line XV-XV in FIG. 14.

FIGS. 14 and 15 show the tensioning element 21, the damping element 17 and the disk 32 in the mounted state. As FIGS. 14 and 15 show, the tensioning element 21 is constructed from a carrier component 59 through which a pin 60 projects. The carrier component 59 forms the counterholder 28, the shaft 26 and the central part of the tensioning section 27. Accordingly, the counterholder 28, the shaft 26 and part of the tensioning section 27 are constructed as one part. The pin 60 forms the two locking elements 29. The pin 60 is plugged through an opening 61 in the carrier component 59 and runs transversely, in the embodiment perpendicularly, with respect to the rotational axis 56. It can be provided that the carrier component 59 is initially mounted on the damping element 17 without the pin 60, and the pin 60 is only inserted into the carrier component 59 after the carrier component 59 is mounted on the damping element 17. Alternatively, in an advantageous configuration, the tensioning element 21 including the pin 60 can be pushed through the damping element 17. The damping element 17 is configured in such a manner that the slot 36 and the opening 39 can be expanded by elastic deformation of the damping element 17, and therefore at least the tensioning section 27 can advantageously be plugged through even when the locking elements 29 are mounted. The assembly, which includes the damping element 17, the tensioning element 21 and the disk 32, is subsequently mounted in the insertion direction 49 (FIG. 2) in the receptacle 18 of the cylinder 11 (FIG. 3).

As FIGS. 10 and 11 show, the slot 36 runs parallel to the transverse side 51. Accordingly, the slot 36 also runs parallel to the longitudinal walls of the receptacle 18. If the damping element 17 is mounted on the cylinder 11, the slot 36 can no longer be substantially expanded. As FIG. 3 shows, in the embodiment, the damping element 17 lies with its transverse sides 51 against the side walls of the receptacle 18. The receptacle 18 prevents both expansion of the damping element 17 and also rotation of the damping element 17 about the rotational axis 56. The slot 36 is dimensioned such that the locking element 29 or the tensioning element 21 can only be pushed through the slot 36 when the damping element 17 is not held on the cylinder 11. After the damping element 17 is mounted on the cylinder 11, mounting or removal of the tensioning element 21 on or from the damping element 17 is no longer possible.

As FIGS. 14 and 15 show, the counterholder 28 and the stop 50 define the axial position of the tensioning element 21 on the damping element 17. The latching unit 53 which is formed between the shaft 26 of the tensioning element 21 and the contour of the opening 39 in the damping element 17 is also shown in FIG. 15. As FIG. 14 shows, the tensioning section 27 has a diameter c. The diameter c is greater than the largest diameter d of the shaft 26. The diameter c is also greater than the largest diameter h of the opening 39, which diameter is shown in FIG. 11. Adjacent to the counterholder 28, the shaft 26 has a seat 62 with an enlarged diameter, as FIG. 14 shows. The seat 62 also secures the axial position of the locking element 29 on the damping element 17. In the embodiment, the locking element 29 is mounted on the damping element 17 without play, preferably with a small prestress of the damping element 17. The counterholder 28 has a diameter e which is significantly greater than the largest diameter d of the shaft 26 and greater than the largest diameter h of the opening 39 (FIG. 11).

As FIG. 14 also shows, the disk 32 extends virtually over the entire width and length of the recess 64. As FIG. 14 shows, only slight play is provided between the disk 32 and the peripheral wall 65. At the edge of the disk 32, a peripheral groove 63 runs adjacent to the abutment 20 in the damping element 17. The peripheral groove 63 reduces the tension in the compressed damping element 17 and reduces the wear between the disk 32 and the damping element 17 at the edge of the disk 32. As FIG. 14 shows, the slot 36 extends as far as narrow wall sections 66 which extend on the second section 34 as far as the peripheral wall 65. The wall sections 66 extend as far as the first section 33 and connect the sections 33 and 34 to each other in the region of the slot 36, as FIGS. 8 and 11 also show. In addition, the sections 33 and 34 are connected via the webs 35 (FIG. 15).

The bevel 37 on the transverse side 51 can also be readily seen in FIG. 15.

FIGS. 16 to 21 show two further embodiments of a closure 15, with only the damping element 17, the tensioning element 21 and the disk 32 being shown. In all of the embodiments, the same reference signs identify mutually corresponding elements. In contrast to the first embodiment, the latching unit in the embodiments below is formed between the counterholder of the tensioning element 21 and the damping element 17.

Figure 16:
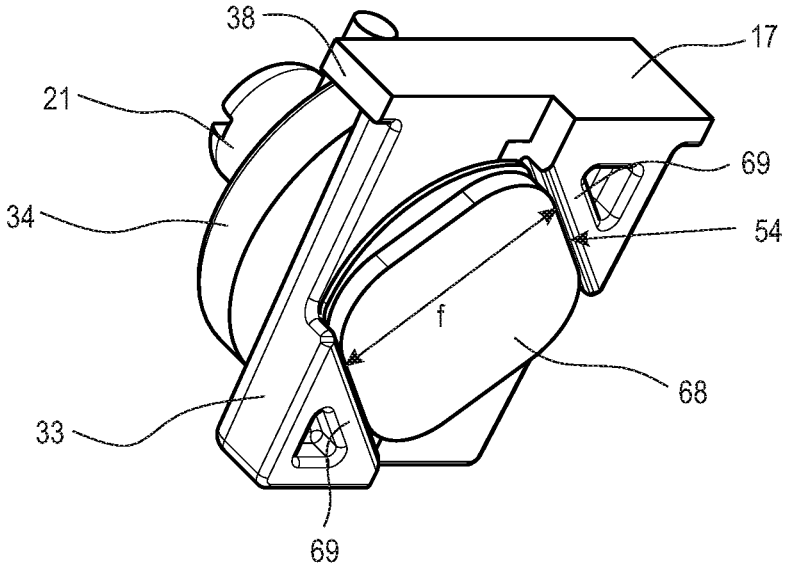
FIG. 16 shows a perspective illustration of an embodiment of the damping element, tensioning element and the disk of a closure.
Figure 17:
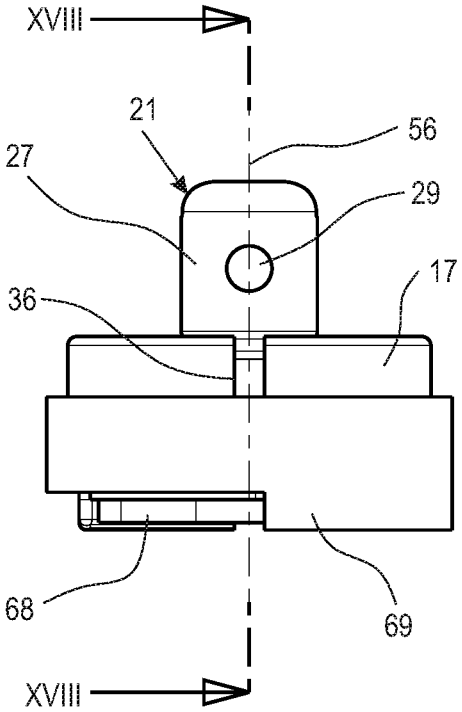
FIG. 17 shows a side view of the damping element, tensioning element and disk from FIG. 16.
Figure 18:
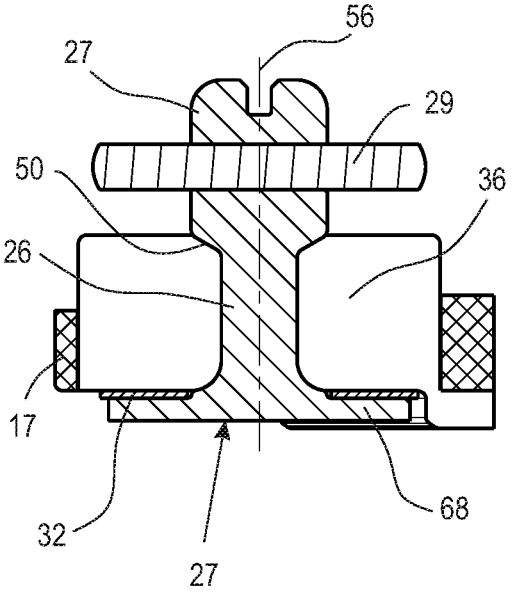
FIG. 18 shows a section along the line XVIII-XVIII in FIG. 17.

In the embodiment shown in FIGS. 16 to 18, the tensioning element 21 has a counterholder 68 which has a square contour with greatly rounded corners. The width f of the square contour of the counterholder 68 corresponds to the distance between mutually opposite peripheral wall sections 69 of the damping element 17. The rotational position of the counterholder 68 is defined via the peripheral wall sections 69. The counterholder 68 can be rotated by elastic deformation of the peripheral wall sections 69, and, in this connection, can be rotated through the diagonal of the square contour between the mutually opposite peripheral wall sections 69, in steps of 90° in the embodiment. The counterholder 68 and the peripheral wall sections 69 form a latching unit 54. In the embodiment according to FIG. 16, the first section 33 of the damping element 17 is of narrower configuration than in the case of the embodiment of the preceding figures. Owing to the fact that the counterholder 68 is not arranged in a recess with a closed peripheral wall, no peripheral wall sections project into a cooling air channel 52 of the cylinder 11 (FIG. 3), and therefore a bevel is unnecessary. Instead of a bevel, the wall sections connecting the peripheral wall sections 69 are absent.

Figure 19:
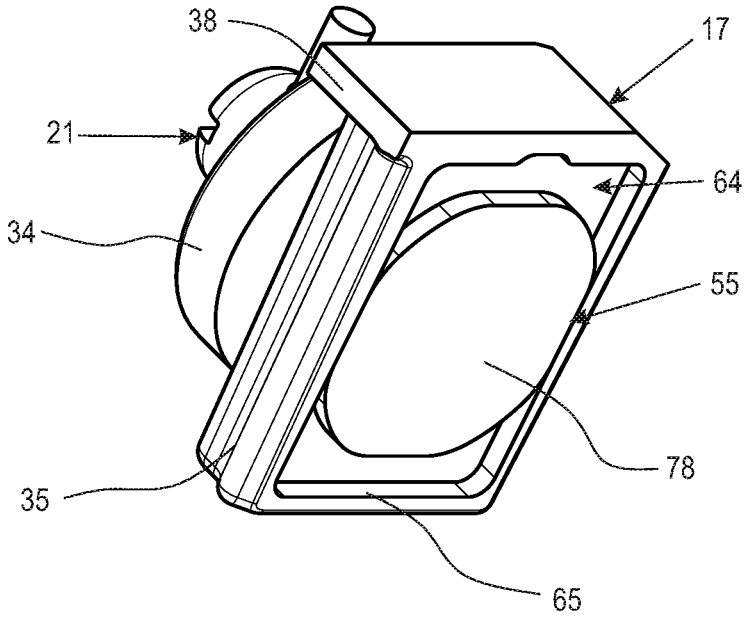
FIG. 19 shows a perspective illustration of a further embodiment of the damping element, tensioning element and disk of a closure.
Figure 20:
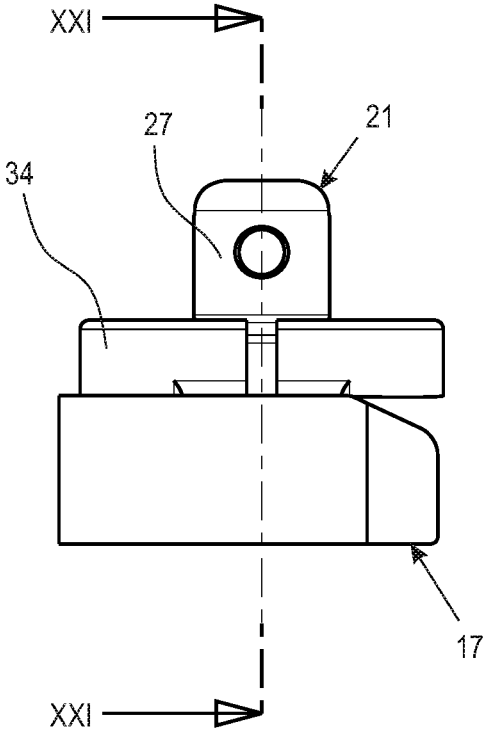
FIG. 20 shows a side view of the damping element, tensioning element and disk from FIG. 19; and, FIG. 21 shows a section along the line XXI-XXI in FIG. 20.
Figure 21:
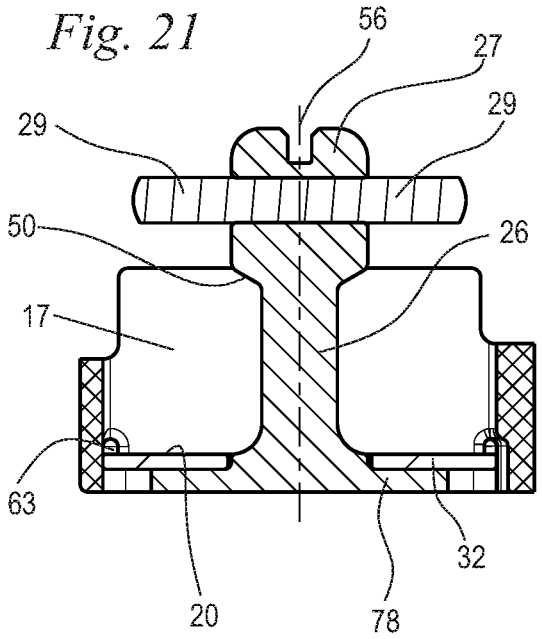

FIGS. 19 to 21 show a further embodiment of the damping element 17, the tensioning element 21 and the disk 32. The tensioning element 21 shown here has a counterholder 78, the shape of which corresponds to the shape of the counterholder 68. However, the counterholder 78 is arranged in a recess 64 which is bounded by an encircling peripheral wall 65. The counterholder 78 together with the peripheral wall 65 forms a latching unit 55. The counterholder 78 defines rotational positions of the locking element 21 that have an angular distance of 90° from one another. One of the rotational positions corresponds to the unlocked position 23 of the closure 15, and the other rotational position corresponds to the locked position 22.

It is understood that the foregoing description is that of the preferred embodiments of the invention and that various changes and modifications may be made thereto without departing from the spirit and scope of the invention as defined in the appended claims.

What is claimed is:

1. A handheld work apparatus comprising:

a combustion engine for driving a tool;

said combustion engine having a cylinder;

a closure including a tensioning element rotatable about a rotational axis and having a locked position and an unlocked position;

a removable cover which is fixed via said closure;

said tensioning element being supported on a tension contour when said closure is in said locked position;

said tensioning element being configured to be rotated by less than one full revolution so as to adjust said closure from said unlocked position to said locked position;

said closure having an elastic damping element for vibration-damping fixation of said cover;

said damping element having a first abutment configured to support said cover thereon in an axial direction of the rotational axis;

said damping element having a second abutment configured to support said tensioning element thereon in the axial direction of the rotational axis;

said damping element being held on a section of said cylinder in the axial direction of the rotational axis;

said tensioning element being moved by said tension contour in the axial direction of the rotational axis during rotation from said unlocked position of said closure into said locked position of said closure;

said tensioning element, when said closure is in said locked position, being configured to clamp said section of said cylinder in the axial direction of the rotational axis between said first abutment and said second abutment of said damping element; and, said tensioning element being held on said damping element on said cylinder when said closure is in said unlocked position.

2. The work apparatus of claim 1, wherein:

said tensioning element has a tensioning section, a counterholder and a shaft;

said tensioning section has at least one locking element;

said at least one locking element is supported on said tension contour when said closure is in said locked position;

said at least one locking element and said counterholder are interconnected via said shaft; and, said shaft at least partially projects through said damping element.

3. The work apparatus of claim 2, wherein:

said damping element defines an opening;

said shaft is arranged in said opening; and, said damping element has a region which surrounds said opening and at least partially overlaps a contour of said tensioning section when said closure is in said unlocked position and thereby secures said tensioning element on said damping element in the axial direction of the rotational axis.

4. The work apparatus of claim 3, wherein:

said damping element defines a slot which, in one of said locked position and said unlocked position of said closure, at least partially overlaps with said at least one locking element; and, said slot is dimensioned such that, for mounting said tensioning element on said damping element, said tensioning section can be pushed through said slot by elastic deformation of said damping element when said damping element is not held on said cylinder.

5. The work apparatus of claim 2, wherein:

said cylinder has a receptacle;

said damping element is arranged in said receptacle of said cylinder; and, said receptacle is configured to rotationally secure said damping element about the rotational axis.

6. The work apparatus of claim 2 further comprising at least one disc arranged between said counterholder and said second abutment of said damping element.

7. The work apparatus of claim 2 further comprising:

a stop formed between said tensioning element and said damping element;

said locking element and said counterholder defining a distance (a) between each other measured in the axial direction of the rotational axis;

said tension contour and said counterholder defining a smallest distance (b) between each other measured in the axial direction of the rotational axis; and, said stop defining a position of said tensioning element in relation to said first abutment of said damping element with respect to the axial direction of the rotational axis in such a manner that, when said closure is in said unlocked position with said cover placed thereon, said distance (a) is greater than said smallest distance (b).

8. The work apparatus of claim 2, wherein:

said tensioning element has an adjusting device for adjusting said tensioning element between said unlocked position and said locked position of said closure; and, said adjusting device is arranged on said tensioning section.

9. The work apparatus of claim 1 further comprising:

a latching unit configured to act between said tensioning element and said damping element in order to secure a rotational position of said tensioning element; and, said tensioning element having a latching position assigned to the position thereof in said locked position.

10. The work apparatus of claim 9, wherein:

said damping element defines an opening;

said tensioning element has a shaft;

said shaft is arranged in said opening; and, said latching unit is formed between said shaft of said tensioning element and said opening of said damping element.

11. The work apparatus of claim 9, wherein:

said tensioning element has a counterholder; and, said latching unit is formed between said counterholder and said damping element.

12. The work apparatus of claim 1, wherein:

said cylinder has a cooling rib; and, said damping element at least partially lies against said cooling rib of said cylinder.

13. The work apparatus of claim 1, wherein:

said cylinder has a cooling rib;

said second abutment runs in an inclined manner with respect to said cooling rib of said cylinder; and, said damping element is beveled on a transverse side.

14. The work apparatus of claim 1, wherein said tension contour is arranged on said cover.

15. The work apparatus of claim 1 further comprising:

a covering for said closure;

said tensioning element including a tensioning section having at least one locking element; and, said covering being held on said cover and at least partially covering said at least one locking element.

* * * * *